US011173734B2

(12) United States Patent
Wang et al.

(10) Patent No.: US 11,173,734 B2
(45) Date of Patent: Nov. 16, 2021

(54) SPACE ADJUSTERS WITH CAM SHAFTS

(71) Applicant: Hewlett-Packard Development Company, L.P., Spring, TX (US)

(72) Inventors: Deyang Wang, Singapore (SG); Adnil San Dela Pena Sazon, Singapore (SG); Bryan Delima Yrogirog, Singapore (SG); Clint Carl Sensano, Singapore (SG); Chern Fong Chong, Singapore (SG); Chin Siang Chua, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 128 days.

(21) Appl. No.: 16/492,864

(22) PCT Filed: Mar. 10, 2017

(86) PCT No.: PCT/US2017/021913
§ 371 (c)(1),
(2) Date: Sep. 10, 2019

(87) PCT Pub. No.: WO2018/164697
PCT Pub. Date: Sep. 13, 2018

(65) Prior Publication Data

US 2021/0138809 A1 May 13, 2021

(51) Int. Cl.
*B41J 25/308* (2006.01)
*B41J 29/02* (2006.01)

(52) U.S. Cl.
CPC ..... *B41J 25/3086* (2013.01); *B41J 25/3082* (2013.01); *B41J 25/3088* (2013.01); *B41J 29/02* (2013.01)

(58) Field of Classification Search
CPC ..... B41J 25/3086; B41J 25/3088; B41J 25/3082; B41J 29/02
See application file for complete search history.

(56) References Cited

U.S. PATENT DOCUMENTS 5,227,809 A 7/1993 Carpenter et al.
5,724,860 A 3/1998 Sekiguchi et al.
5,777,635 A 7/1998 James, III et al.
(Continued)

OTHER PUBLICATIONS

DASCOM~Flatbed Printer for DRK Hospital in Saarlousis, 2012, < http://www.dascom.co.uk/~2 pages.
(Continued)

*Primary Examiner* — Henok D Legesse
(74) *Attorney, Agent, or Firm* — HP Inc. Patent Department

(57) ABSTRACT

In an example, a space adjuster may comprise a cam shaft, a first fin disposed on a first end of the cam shaft, a second fin disposed on a second end of the cam shaft, opposite from the first end, and a cam lug disposed on the cam shaft in between the first end and the second end. The first fin may have a first profile to transfer a first longitudinal force into a first rotation of the cam shaft, and the second fin may have a second profile to transfer a second longitudinal force into a second rotation of the cam shaft, opposite to the first rotation. A cam surface of the cam lug may be spaced increasingly farther away from a longitudinal axis of the cam shaft throughout the first rotation of the cam shaft.

15 Claims, 9 Drawing Sheets

(56) References Cited

U.S. PATENT DOCUMENTS

| | | | | |
|---|---|---|---|---|
| 5,967,677 | A | 10/1999 | McCue et al. | |
| 6,102,509 | A | 8/2000 | Olson | |
| 6,652,078 | B2 | 11/2003 | Silverbrook | |
| 6,840,598 | B2 | 1/2005 | Fairchild et al. | |
| 6,874,956 | B2 | 4/2005 | Kelley et al. | |
| 7,044,575 | B2 * | 5/2006 | Kelley | B41J 25/308 347/16 |
| 7,145,833 | B1 | 12/2006 | Hoogeveen | |
| 2015/0116395 | A1 | 4/2015 | Schelmbauer | |

OTHER PUBLICATIONS

Oki America~Microline® 520/521 Printer Handbook, < http://www.okiservice.pt/~Feb. 4, 1996 ~47 pages.

* cited by examiner

SPACE ADJUSTERS WITH CAM SHAFTS

BACKGROUND

Electronic devices such as imaging devices may perform operations on or with print media. A portion of the electronic device may be spaced away from the print media in order to perform such operations on or with the print media. A plurality or variety of different print media types, thicknesses, sizes, and/or materials may be used in the electronic device. An optimal space or distance between the print media and the portion of the electronic device that performs operations on or with the media may depend on the type of print media in use with the electronic device.

DETAILED DESCRIPTION

Figure 1:
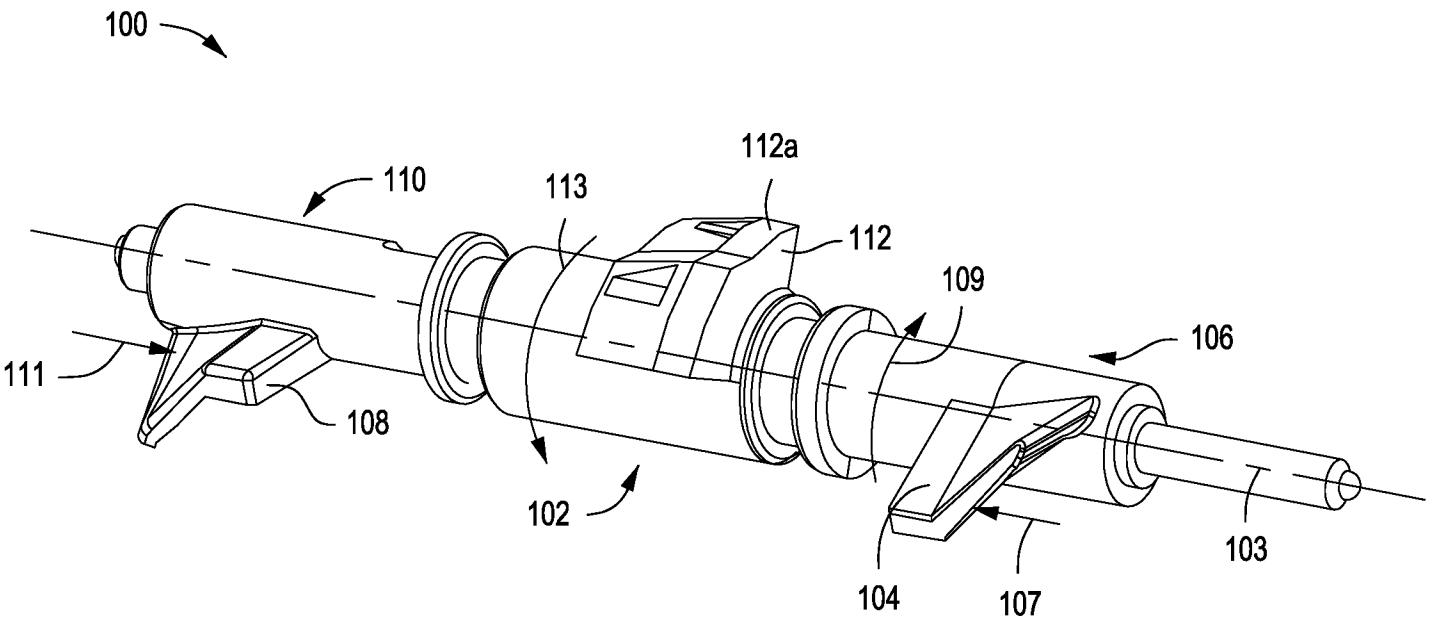
FIG. 1 is a perspective view of an example space adjuster.

Electronic devices, such as imaging devices, for example, may perform operations on or with media, sometimes referred to as print media or a print medium. The print media may be driven or delivered through the electronic device, and/or an operation zone or print zone therein. A portion of the electronic device may carry out operations on or with the print media as the print media travels through the operation zone. The portion of the electronic device may be spaced away from a platen in the operation zone, and thus from the print media, in order to perform such operations on or with the print media. In some situations, this space or distance between the portion of the electronic device and the print media is a fixed distance. Sometimes, if the space or distance between the portion and the print media is too close or too tight, the print media may jam or experience damage from being delivered through the operation zone with insufficient clearance. In other situations, if the space or distance is too great, the quality of the operation performed on or with the print media may suffer.

A plurality or variety of different media types, thicknesses, sizes, and/or materials may be used in the electronic device in some situations. Thus, the fixed distance between the portion of the electronic device and the platen may not be an optimal distance for every type of print media. In other words, each or some of the different types of print media may have a preferred space or distance from a portion of the electronic device that is to carry out operations on or with the print media. The preferred distance or space may ensure high-quality operations are carried out with or on the print media, and that the print media does not experience damage or other unwanted effects. Certain types of print media may experience such damage or low-quality operations from being used in an electronic device with a fixed space or distance between the platen and the portion of the electronic device that carries out operations on or with the print media.

In some situations, it may be desirable to have an adjustable space or distance between a platen within an electronic device and the portion of the electronic device that carries out operations on or with the print media moving over the platen. It may be desirable to adjust such space or distance depending on the type of print media to be used in the electronic device. Some electronic devices may include a system to adjust such a space or distance, but such a system may occupy or take up excessive volume within the electronic device, or may use an excessive side-to-side movement of a carriage in the electronic device to adjust the space or distance.

Implementations of the present disclosure provide example space adjusters that may adjust the space between a platen, or print media travelling over the platen, within an electronic device, and a portion of the electronic device that carries out operations on or with the print media. Such example space adjusters may actuate and change such a space or distance with minimal side-to-side movement of a carriage within the electronic device. Further, example space adjusters as described herein may enable an electronic device to optimally use multiple types of print media, while avoiding a loss of operation quality, and also avoiding jams or damage to the print media.

Referring now to FIG. 1, a perspective view of an example space adjuster 100 is illustrated. Example space adjuster 100 may include a cam shaft 102, having a first end 106 and a second end 110 opposite from the first end 106. The cam shaft 102 may be an elongate member or beam, and may be rigid or semi-rigid in some implementations. In further implementations, the cam shaft 102 may be a cylinder or a round or rounded bar, and may have a longitudinal axis 103 extending along the length of the cam shaft 102. In some implementations, the cam shaft 102 may include various shoulders, steps, notches, grooves, or other features that may enable the cam shaft 102 to be installed or assembled to other components.

The example space adjuster 100 may also include a first fin 104 disposed on the first end 106. The first fin 104 may have a first profile or geometry to transfer a first longitudinal force 107 into a first rotation 109 of the cam shaft 102. The first fin 104 may be a vane (sometimes referred to as a set vane), or a blade, having a curvature that extends axially along the cam shaft 102, radially from the cam shaft 102, and/or circumferentially about the cam shaft 102 to transfer the first longitudinal force 107 into the first rotation 109 of the cam shaft 102. In some implementations, the first fin 104 may extend in a helical or semi-helical fashion about the cam shaft 102. In further implementations, the first fin 104 may be a flat wing, plate, tab, or other protrusion capable of transferring a longitudinal force into a rotational movement. In further implementations, the first longitudinal force 107 may be exerted against the first fin 104 in a direction along the cam shaft 102, or the longitudinal axis 103, thereof. Further, the first rotation 109 may be a rotation of the space adjuster 100, or the cam shaft 102 thereof, about the longitudinal axis 103.

In further implementations, the example space adjuster 100 may have a second fin 108 disposed on the second end 110. The second fin 108 may have a second profile or geometry to transfer a second longitudinal force 111 into a second rotation 113 of the cam shaft 102. The second rotation 113 may be opposite to the first rotation 109. In other words, the second rotation 113 may be a rotation of the space adjuster 100, or the cam shaft 102 thereof, about the longitudinal axis 103, in some implementations, in a direction opposite to the direction of the first rotation 109. The second fin 108 may be a vane (sometimes referred to as a reset vane), or a blade, having a curvature that is similar to the set vane curvature of the first fin 104, in some implementations. In other implementations, the reset vane may have a curvature that is substantially opposite to the curvature of the set vane. In other implementations, the reset vane may have a structure or curvature that is different from the set vane, yet is still capable of transferring the second longitudinal force 111 into the second rotation 113. The curvature of the reset vane may extend axially along the cam shaft 102, in a direction opposite from the set vane, to transfer the second longitudinal force 111 into the second rotation 113 of the cam shaft 102. In further implementations, the second longitudinal force 111 may be exerted against the second fin 108 along the longitudinal axis 103 of the cam shaft 102 in a direction that is opposite to the direction of the first longitudinal force 107. It should be noted that, while both the first rotation 109 and the second rotation 113 are illustrated on the cam shaft 102 in FIG. 1, the cam shaft 102 may be a rigid component such that only the first rotation 109 or the second rotation 113 are able to occur at a time, not both. It should also be noted that, while the first longitudinal force 107 and the second longitudinal force 111 are illustrated as discrete force vectors aligned along the axial direction of the cam shaft 102, either or both of the first and second longitudinal forces 107, 111 may be a single constituent component (along such an axial direction) of another force vector extending in another direction. In other words, a force vector may be exerted against the relevant first or second fin in any direction, and as long as that force vector has a force component in the axial direction of the cam shaft 102, then the relevant first or second fin will transfer that force component into the associated rotation of the cam shaft 102, with such associated rotation being proportional to the force component.

The example space adjuster 100 may also include a cam lug 112 disposed on the cam shaft 102 in between the first end 106 and the second end 110, and/or in between the first fin 104 and the second fin 108. In some implementations, the cam lug 112 may be a protruding unitary portion of the cam shaft 102 that extends radially from the cam shaft 102 and circumferentially about the cam shaft 102. In other implementations, the cam lug 112 may be a separate or discrete component from the cam shaft 102 and may be assembled or fixed on to the cam shaft 102. The cam lug 112 may have or define a cam surface 112*a* that is spaced radially from the cam shaft 102. The cam lug 112 may have a structure such that, as the cam lug 112 extends circumferentially around the cam shaft 102, the cam surface 112*a* moves away from the cam shaft 102. In other words, the cam surface 112*a* of the cam lug 112 may be spaced increasingly farther away from the longitudinal axis 103 of the cam shaft 102 throughout the first rotation 109 of the cam shaft. Stated yet another way, as the space adjuster, or the cam shaft 102 thereof, moves throughout the first rotation 109, the cam surface 112*a* moves farther away from the cam shaft 102, or the longitudinal axis 103 thereof. Accordingly, as the space adjuster 100, or the cam shaft 102 thereof travels along the second rotation 113, the cam surface 112*a* moves closer to the cam shaft 102, or the longitudinal axis 103 thereof.

Figure 2A:
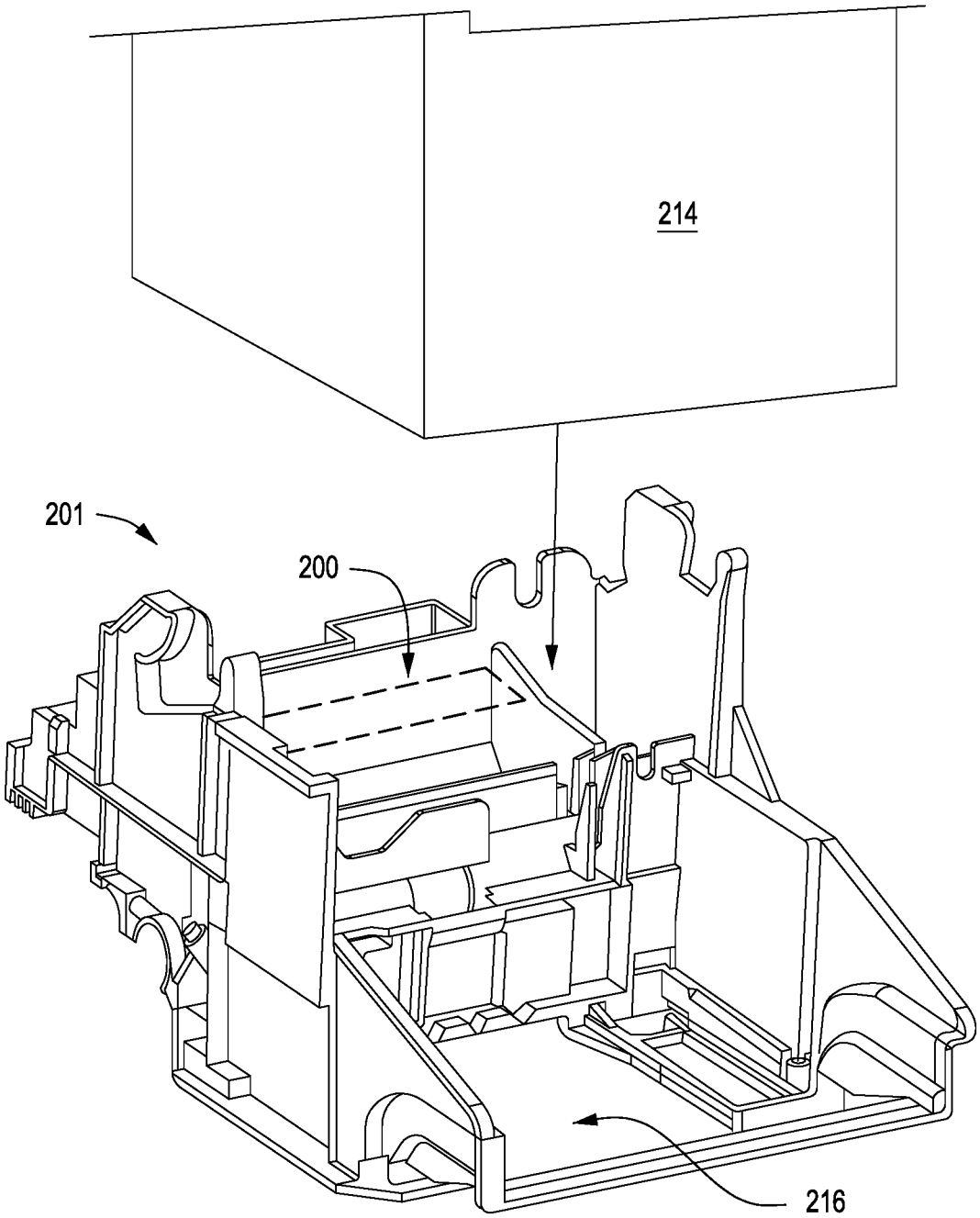
FIG. 2A is a perspective view of a carriage having an example space adjuster.

Referring now to FIG. 2A, a front perspective view of a carriage 201 having an example space adjuster 200 is illustrated. The space adjuster 200 may be disposed on the carriage 201. Space adjuster 200 is shown in phantom lines as it may be disposed on a back side or hidden side of the illustrated carriage 201. In other implementations, the space adjuster 200 may be disposed on another portion of the carriage 201. The carriage 201 may receive a cartridge 214, which may be a print cartridge 214, in some implementations. The carriage 201 may receive the print cartridge 214 within a cartridge dock 216 of the carriage. The cartridge dock 216 may be a cradle, receptacle, or other structure to mechanically support the print cartridge 214 and removably fix the print cartridge 214 to the carriage 201. The print cartridge 214 may be a receptacle or vessel to hold a print fluid, in some implementations, and may deposit such print fluid on media or print media. Print fluid may refer to a material or substance that may be used in operations performed on or with media, such as ink, in some implementations. In further implementations, the print cartridge 214 may include a nozzle or printhead, from which print fluid may be ejected on to print media. The cartridge 214 may be engaged with the carriage 201 such that the nozzle or printhead, or another component that may eject print fluid, may eject the print fluid from a bottom surface of the carriage 201. In other implementations, the print cartridge 214 may be a conduit to fluidly engage a nozzle disposed on the print cartridge 214 with a remote print fluid reservoir disposed elsewhere other than the carriage 201. In yet other implementations, the print cartridge 214 may be another type of cartridge that may contain a material to be used in operations performed on or with media.

Figure 2B:
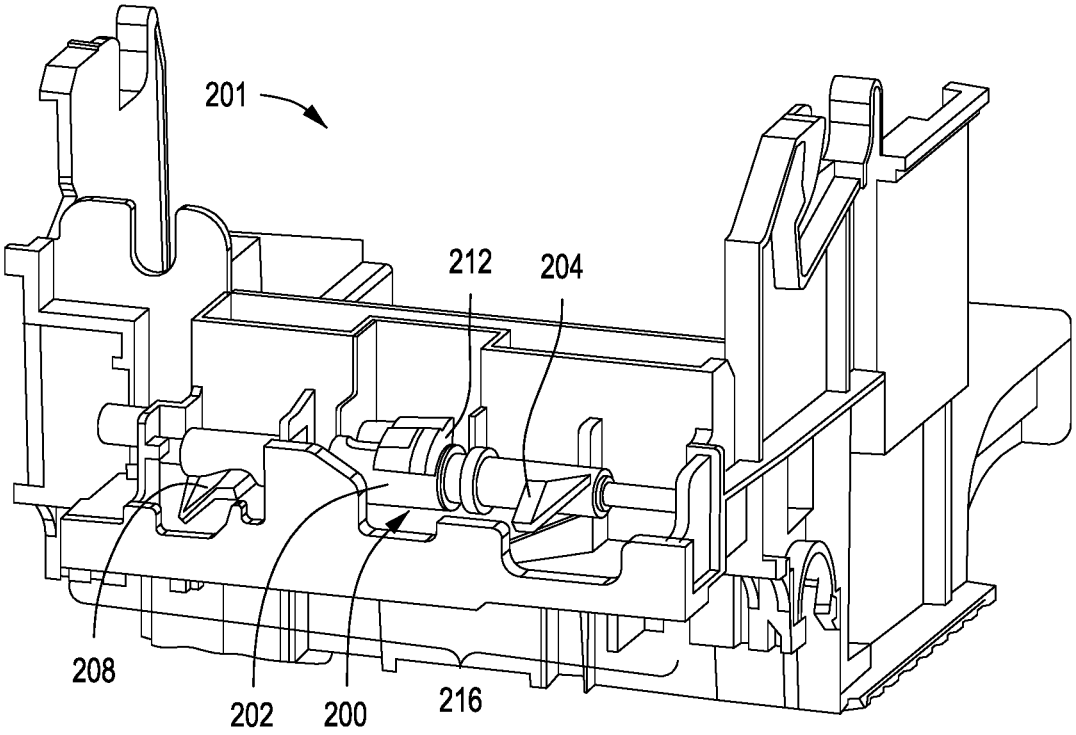
FIG. 2B is a perspective view of a carriage having an example space adjuster.

Referring now to FIG. 2B, a rear perspective view of a carriage 201 having the example space adjuster 200 is illustrated. For clarity, the cartridge 214 is omitted from FIG. 2B. Example space adjuster 200 may be similar to example space adjuster 100. Further, the similarly-named elements of example space adjuster 200 may be similar in function and/or structure to the elements of example space adjuster 100, as they are described above. The example space adjuster 200 may be disposed on a support structure 216 of the carriage 201, which may mechanically retain and/or support the space adjuster 200, while enabling the space adjuster 200 to rotate relative to the carriage 201. In some implementations, the support structure 216 may be a unitary part of the carriage 201, or, in other implementations, the support structure 216 may be a discrete or separate component that may be assembled on to or attached to the carriage 201. The example space adjuster 200 may have a cam shaft 202, and a cam lug 212, a first fin 204, and a second fin 208 disposed on and/or extending from the cam shaft 202.

Figure 3A:
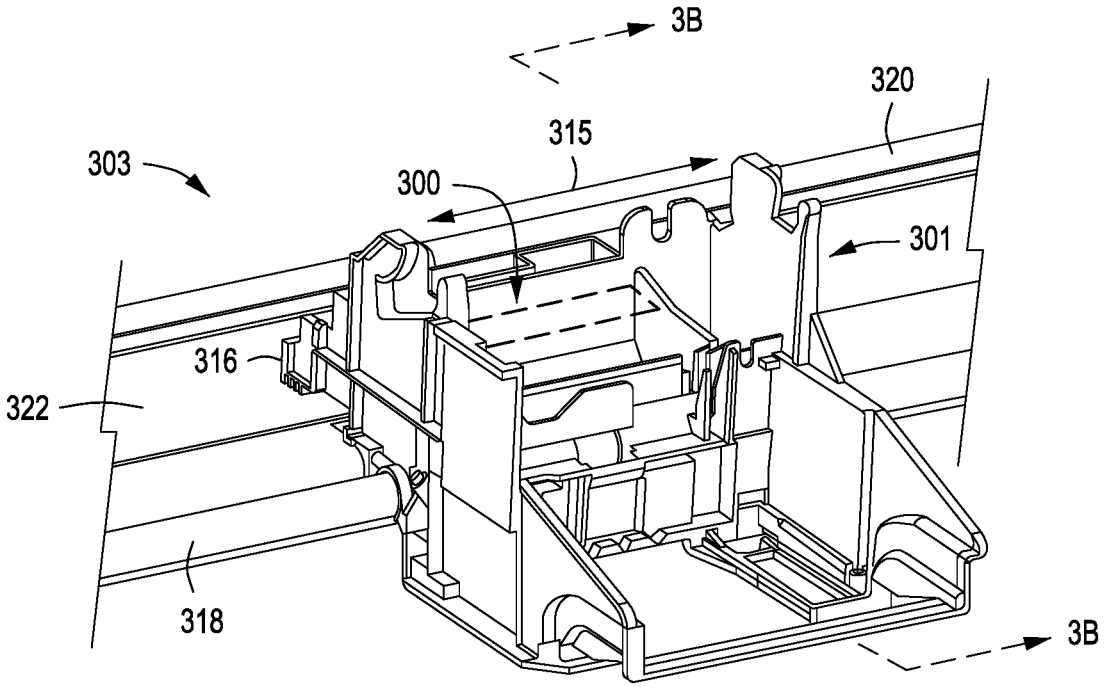
FIG. 3A is a perspective view of a carriage assembly having an example space adjuster.
Figure 3B:
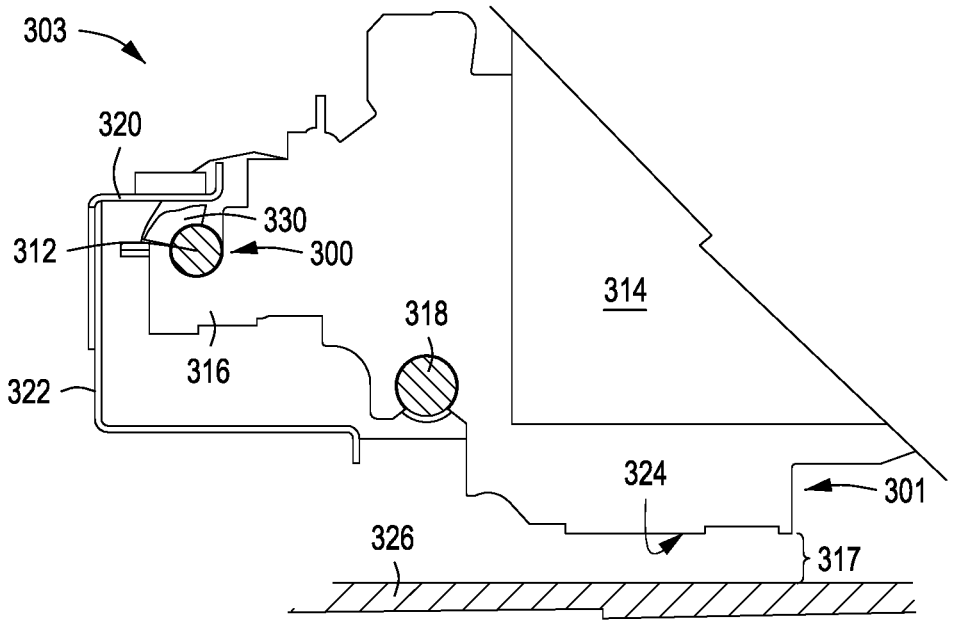
FIG. 3B is a cross-sectional view of a carriage assembly having an example space adjuster.

Referring now to FIGS. 3A-3B, a front perspective view and a cross-sectional view of an example carriage assembly 303 having an example space adjuster 300 is illustrated, respectively. In some implementations, carriage assembly 303 may include a carriage 301. Example space adjuster 300 and carriage 301 may be similar to other example space adjusters and carriages described above. Further, the similarly-named elements of example space adjuster 300 and carriage 301 may be similar in function and/or structure to the elements of other example space adjusters and carriages, as they are described above. It should be noted that FIG. 3B shows a cartridge 314 (which may be similar to cartridge 214) engaged with the carriage 301, while, for clarity, such cartridge 314 is omitted from FIG. 3A. In some implementations, the carriage assembly 303 may include a frame 322. The frame 322 may be a component of a larger electronic device, in some implementations. The frame 322 may be a beam, strut, panel, or a structural portion of a housing, in some implementations. In further implementations, the carriage 301 and the space adjuster 300 may be movable together, relative to the frame 322.

The frame 322 may include a rail 320 extending along a length of travel of the carriage 301. In some implementations, the rail 320 may be a beam or strut, or another suitably rigid member that may engage with the carriage 301 and/or the space adjuster 300. In further implementations, the rail 320 may extend laterally from the frame 322 towards the carriage 301, and may overlap or extend over a portion of the carriage 301, and/or a support structure 316 thereof. In yet further implementations, the rail 320 may extend over the support structure 316, and the space adjuster 300 may be cradled or otherwise supported by the support structure 316, such that the space adjuster 300 is disposed in between the support structure 316 and the rail 320. The space adjuster 300 may engage the carriage 301 with the rail 320. The frame 322 may also include a carriage rod 318, slidably engaged with the carriage 301, in some implementations. The carriage 301 may be moved or translated along the carriage rod 318, relative to the frame 322 and the rail 320. In yet further implementations, the carriage 301 and the space adjuster 300 may be moved along a longitudinal direction 315 (which may sometimes be referred to as a side-to-side direction), relative to the frame 322 and the rail 320.

In further implementations, the carriage 301 and the cartridge 314 engaged therewith may be pivotable about the carriage rod 318. In some implementations, the space adjuster 300 may include a cam lug 312 that may interface with the rail 320, or an underside thereon. The cam lug 312 may include a low portion 330 and a high portion, and a cam surface that may be defined by outer surfaces of the low portion 330 and the high portion. Such an interface between the cam lug 312 and the rail 320 may define the carriage's angular position about the carriage rod 318, and such angular position about the carriage rod 318 may determine a distance in between a bottom surface 324 of the carriage 301 and a platen 326 of an electronic device on or in which the carriage assembly 303 may be disposed. For example, if the space adjuster 300 were disposed in a first stage, as illustrated in FIG. 3B, the low portion 330 of the cam lug 312, or an outer surface thereof, may be engaged with the rail 320, and the height of the low portion 330 relative to a cam shaft of the space adjuster 300 may define a first distance 317 in between the bottom surface 324 of the carriage 301 and the platen 326. The first distance 317 may refer to a height of an operation zone in between the platen 326 and the bottom surface 324 of the carriage 300 through which media or print media may be delivered such that the cartridge 314, or a nozzle or printhead thereon, may perform an operation on or with the media. The platen 326 may refer to a base plate, surface, or floor of the operation zone. In some implementations, the operation zone may be referred to as a print zone. It should be noted that reference is made to the space or distance of the operation zone as being in between the platen 326 and the bottom surface 324. However, such a space or distance may also refer to the space or distance between the platen 326 and the nozzle or printhead of the cartridge 314, which may be at or near the bottom surface 324 of the carriage 301.

Figure 3C:
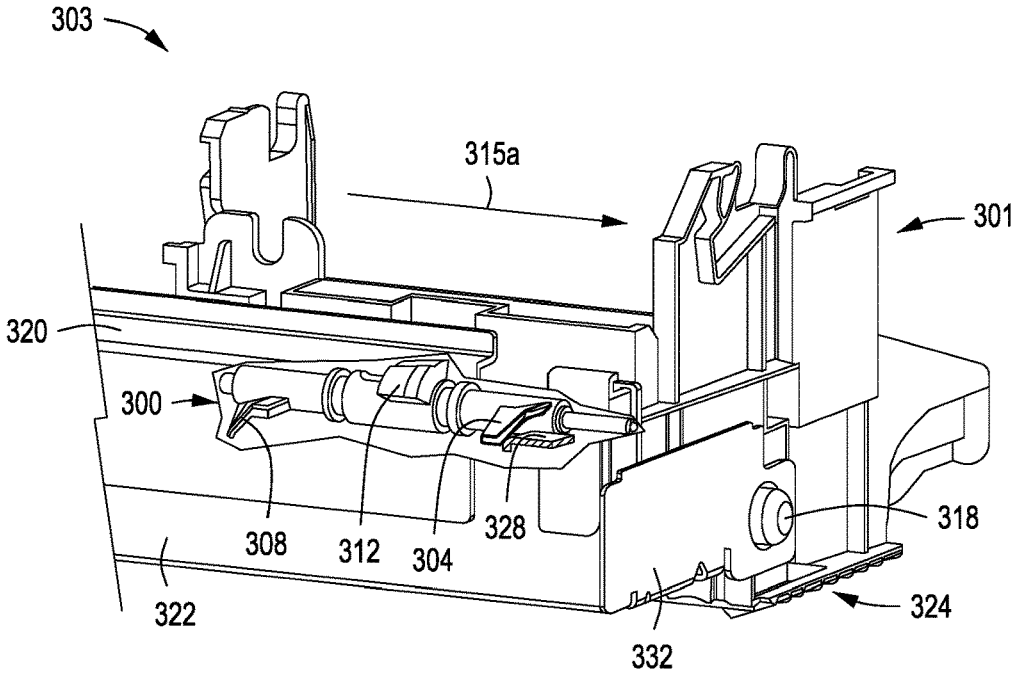
FIG. 3C is a perspective view of a carriage assembly having an example space adjuster.

Referring now to FIG. 3C, a rear perspective view of the carriage assembly 303 is illustrated wherein the carriage 301 has been moved along a first longitudinal direction 315*a* relative to the frame 322 and the rail 320 towards a first end 332 of the frame 322. The first end 332 may also be considered or referred to as a first end of the carriage assembly 303, in some implementations, and/or may be considered a first end of an electronic device, within which the carriage assembly 303 or carriage 301 may be disposed. For clarity, FIG. 3C has an illustrated cutaway to expose the space adjuster 300 disposed behind the frame 322 and underneath the rail 320. The frame 322 may include a first actuator 328 illustrated in the cutaway and disposed at or near the first end 332 of the frame 322. The first actuator may be a tab, pin, plate, rib, or another protrusion that may be fixed to the frame 322 in an appropriate position to interface with the space adjuster 300, or a portion thereof, upon the space adjuster 300 being disposed at or near the first end 332. In other implementations, the first actuator 328 may be fixed to another portion of the carriage assembly 303, or the electronic device. In the illustrated example, the carriage 301 may have been moved along the carriage rod 318 in the first longitudinal direction 315*a* until a first fin 304 of the space adjuster 300 has come into contact with the first actuator 328 of the frame 322.

Figure 3D:
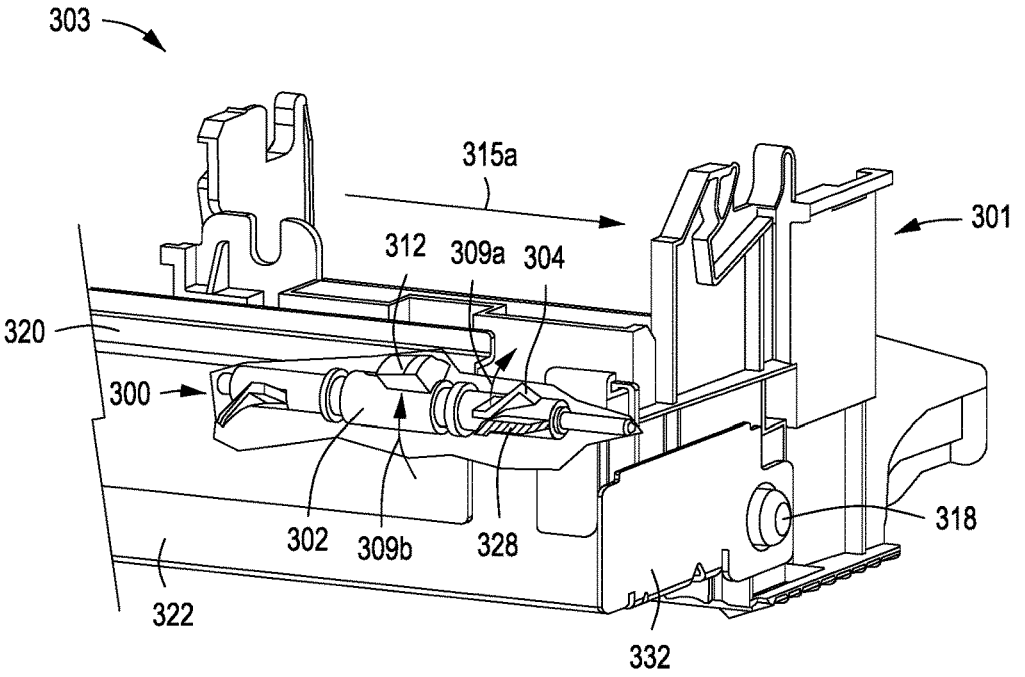
FIG. 3D is a perspective view of a carriage assembly having an example space adjuster.
Figure 3E:
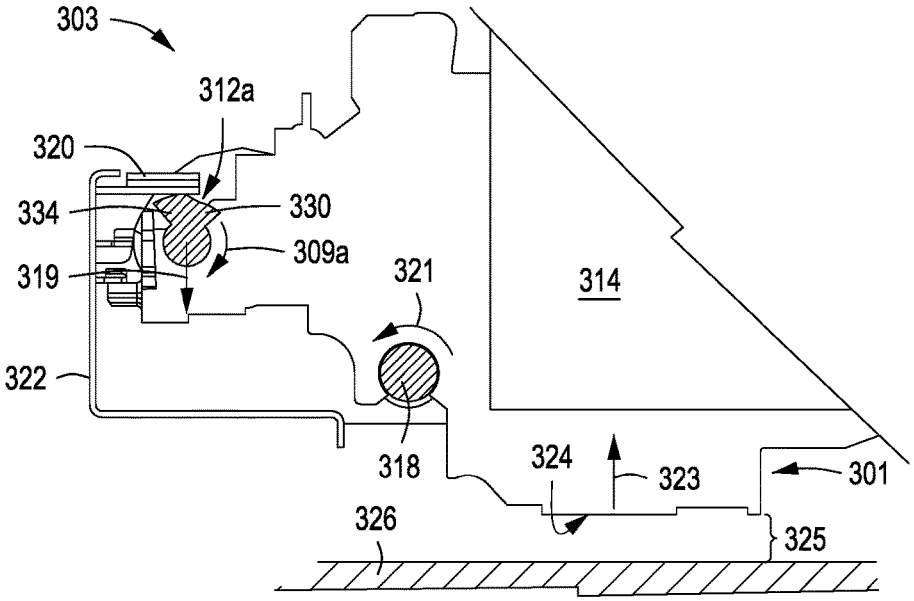
FIG. 3E is a cross-sectional view of a carriage assembly having an example space adjuster.

Referring now to FIGS. 3D-3E, another perspective cutaway view of the example carriage assembly 303 is illustrated, wherein the carriage 301, and thus the space adjuster 300, has been further moved or translated along the first longitudinal direction 315*a* so that the first actuator 328 has further engaged with the first fin 304. The first actuator 328 may have a sufficient structure to engage with the first fin 304 and to cause a curvature or profile of the first fin 304 to move along the first actuator 328, as the space adjuster 300 moves along the first longitudinal direction 315*a*, to cause the first fin 304 to move in a first rotation 309*a*. Stated differently, the movement of the space adjuster 300 along the first longitudinal direction 315*a* may cause the first actuator 328 to exert a first longitudinal force (which may be similar to the first longitudinal force 107 of FIG. 1) against the first fin 304, resulting in a rotation of the first fin 304 about a longitudinal axis of the space adjuster 300, or a cam shaft 302 thereof. Therefore, the first actuator 328 may exert the first longitudinal force against the first fin 304 to cause the first rotation 309*a* if the carriage 301 is moved or travels to or sufficiently near the first end 332. Such an engagement of the first fin 304 with the first actuator 328 may sometimes be referred to as an arrangement wherein the first actuator 328 may actuate the first fin 304 if the carriage 301 is moved to the first end 332. The first fin 304, being fixed or attached to the cam shaft 302, also causes the cam shaft 302 to move in the first rotation 309*a*. In other words, the first fin 304 may receive and be actuated by the first actuator 328 to cause a first rotation 309*a* of the cam shaft 302. The cam lug 312, being fixed or attached to the cam shaft 302, may also rotate due to the first rotation 309*a* of the cam shaft. Such a cam lug rotation is illustrated by arrow 309*b* in FIG. 3D.

Referring still to FIG. 3E, the first rotation 309*a* may cause the cam lug to rotate relative to the frame 322 and the rail 320 such that the cam surface 312*a*, defined by outer surfaces of the low portion 330 and the high portion 334, slides against the rail 320, or an underside thereon. The cam surface 312*a* may be defined by the outer surfaces of the low portion 330 and the high portion 334 such that the cam surface 312*a* is closer to the cam shaft 302, or a longitudinal axis thereof, on the low portion 330, and farther from the cam shaft 302, or the longitudinal axis thereof, on the high portion 334. In some implementations, the low portion 330 and the high portion 334 may have a step-like structure transitioning between the two. In further implementations, the low portion 330 and the high portion 334 may refer to a first end and a second end, respectively, of a smooth cam structure. Thus, the cam surface 312*a* of the cam lug 312 may be disposed increasingly farther from the cam shaft as the cam lug 312 extends from the low portion 330 to the high portion 334.

The cam surface 312*a* may slide against the rail to cause the low portion 330 to stop pressing against the rail 320, or the underside thereon, and to cause the high portion 334 to start pressing against the rail 320, or the underside thereon. In other words, the first rotation 309*a* of the cam shaft 302, and thus the cam lug 312, may cause a transition from the cam lug 312 pressing against the rail 320 with the low portion 330 to the cam lug 312 pressing against the rail 320 with the high portion 334. Such a transition may cause the space adjuster 300 to move in a direction 319, away from the rail 320, and may also represent a transition of the space adjuster 300 from the first stage, illustrated in FIG. 3B, to a second stage, illustrated in FIGS. 3D-3E. In other words, the first rotation 309*a* may switch the space adjuster 300 from the first stage to the second stage. The space adjuster 300, being disposed on or attached to the carriage 301, may thus also cause the carriage 301, or a support structure thereof, to move away from the rail 320. The fixed nature and location of the carriage rod 318 relative to the space adjuster and the rail 320 may result in the carriage pivoting about the carriage rod 318 in a direction 321, as illustrated in FIG. 3E, throughout the transition from the first stage to the second stage. In other words, the transition from the low portion 330 pushing against the rail 320 to the high portion 334 pushing against the rail 320 may change the angular position of the carriage 301 about the carriage rod 318. Thus, in some implementations, the cam lug 312 may push or press against the rail 320 so that the carriage 301 pivots away from, or the cam lug pivots the carriage 301 away from, the rail 320 during the first rotation 309*a* of the cam shaft 302.

The movement of the carriage 301 about the carriage rod 318, i.e., the change in angular position of the carriage 301 about the carriage rod 318, may cause the bottom surface 324 of the carriage 301 to move away from the platen 326 of an electronic device along an approximate direction 323. Such movement of the bottom surface 324 thus may increase the space or distance between the bottom surface 324 and the platen 326. In other words, the carriage 301 may be pivoted about the carriage rod 318 by the cam lug 312 of the space adjuster 300 to define a second distance 325, which is greater than first distance 317 of FIG. 3B, between the bottom surface 324 of the carriage 301 and the platen 326.

Figure 4A:
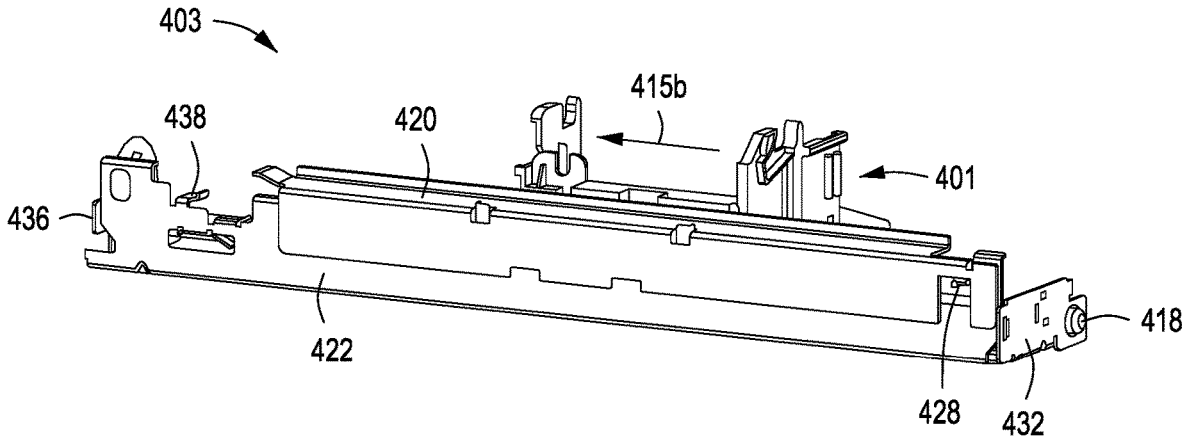
FIG. 4A is a perspective view of a carriage assembly having an example space adjuster.

Referring now to FIG. 4A, a perspective view of an example carriage assembly 403 having an example carriage 401 and space adjuster 400 is illustrated. Example space adjuster 400 and carriage assembly 403 may be similar to other example space adjusters and carriage assemblies described above. Further, the similarly-named elements of example space adjuster 400 and carriage assembly 403 may be similar in function and/or structure to the elements of other example space adjusters and carriage assemblies, as they are described above. The carriage assembly 403 may illustrate the carriage 401 as having been moved along a second longitudinal direction 415*b*. Second longitudinal direction 415*b*, in some implementations, may be opposite to first longitudinal direction 315*a*. Thus, the carriage 401 may be moved from a first end 432, along, the second longitudinal direction 415*b*, towards a second end 436 of a frame 422 of the carriage assembly 403, or of an electronic device within which the carriage assembly 403 may be disposed. The second end 436 may be opposite the first end 432. In some implementations, the carriage 401 may be moved towards the second end 436 such that a second actuator 438, disposed at or near the second end 436, may engage with the space adjuster 400 in order to transition the space adjuster 400 from a second stage to a first stage.

Figure 4B:
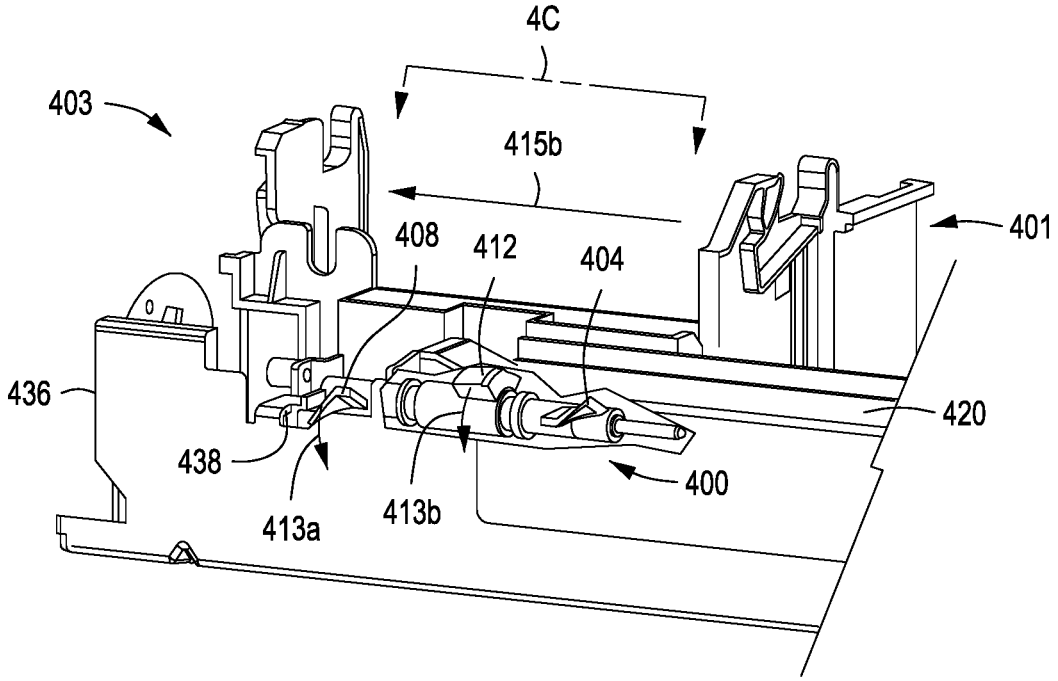
FIG. 4B is a perspective view of a carriage assembly having an example space adjuster.

Referring additionally to FIG. 4B, a perspective cutaway view of the carriage assembly 403 is illustrated to show such engagement between the space adjuster 400 and the second actuator 438. In some implementations, the space adjuster 400 may include a first fin 404, a second fin 408, and a cam lug 412. The space adjuster 400 may be moved along the second longitudinal direction 415*b* with the carriage 401 until the second fin 408 contacts and engages with the second actuator 438. In some implementations, the second actuator 438 may be similar to the first actuator 428, and may be fixed or attached to the frame 422, or another component of the carriage assembly 403 that may remain fixed relative to the carriage 401 as the carriage 401 is moved. The engagement of the second actuator 438 with the second fin 408 may be similar to the engagement between the first actuator 428 and the first fin 404, and may result in a second rotation 413*a* of the space adjuster 400, or the second fin 408. In other words, the second fin 408 may receive and be actuated by the second actuator 438 to cause the second rotation 413*a*, which may be opposite to the first rotation, described above, as the carriage 401 moves along the second longitudinal direction 415*b*. Stated differently, the second actuator 438 may actuate the second fin 408 if the carriage 401 is moved to the second end 436. Described yet further, the second actuator 438 may exert a second longitudinal force, similar to second longitudinal force described with reference to FIG. 1, against the second fin 408 to cause the second rotation 413*a* if the carriage 401 is moved to the second end 436. The cam lug 412, being fixed or attached to the space adjuster 400, may also rotate similar to the second rotation 413*a*. Such rotation of the cam lug 412 may be illustrated by arrow 413*b*, and may cause the cam lug 412 to transition from engaging with the rail 420 with a high portion of the cam lug 412 to engaging with the rail using a low portion of the cam lug 412. This transition may be substantially opposite in nature from the transition described above regarding the cam lug changing from pressing against the rail using the low portion to pressing against the rail with the high portion. Thus, the cam lug 412, or a cam surface thereof, may rotate so as to pivot the carriage 401 towards the rail during the second rotation 413*a*, in contrast to pivoting the carriage away from the rail during the first rotation, as described above. Accordingly, the space adjuster 400, or the cam lug 412 thereof, may cause the carriage 401 to pivot or change its angular position about a carriage rod 418 of the carriage assembly 403 in order to cause a bottom surface of the carriage 401 to move towards a platen of an electronic device, within which the carriage assembly 403 may be disposed, if the carriage 401 pivots towards the rail 420 during the second rotation 413*a*.

Therefore, in some implementations of the present disclosure, the carriage 401 having the space adjuster 400 may be moved to the first side 432 in order to switch from the first stage to the second stage and increase the space or distance in between the bottom surface of the carriage 401 and the platen and, therefore the space or distance from the bottom surface and media moving over the platen through the operation zone. Additionally, if the type of media is changed, and/or a smaller space or distance is desired in between the bottom surface of the carriage and the media, the carriage 401 may be moved to the second end 436 to cause the second rotation 413*a* in order to switch the space adjuster 400 from the second stage back to the first stage, thereby lowering or decreasing such distance in between the bottom surface of the carriage 401 and the media, or the platen thereunder.

Figure 4C:
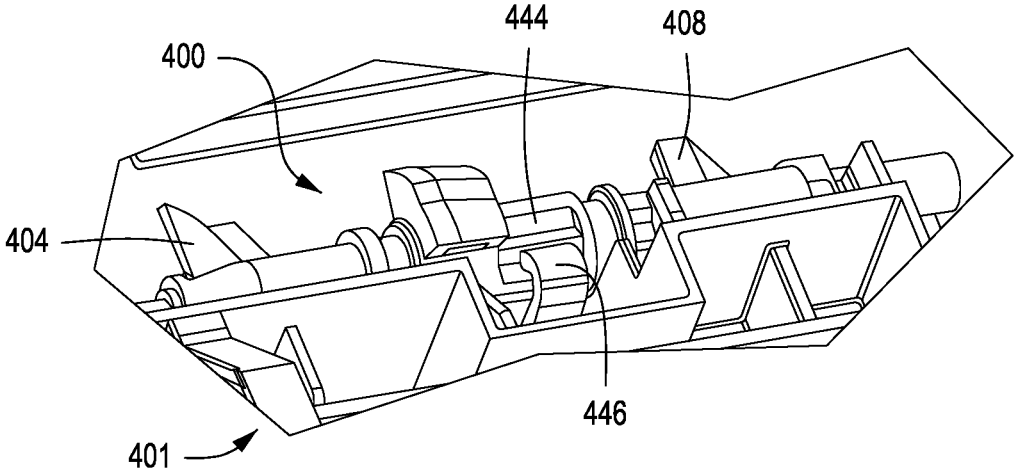
FIG. 4C is a perspective view of a carriage assembly having an example space adjuster.

Referring now to FIG. 4C, a top perspective view of the example space adjuster 400 is illustrated, wherein the view is taken in a direction similar to that indicated in FIG. 4B. Example space adjuster 400 may include a lock feature 444 to engage with a lock latch 446. The lock latch 446 may be a hook, tab, or other suitable protrusion to engage with the lock feature 444 and may be disposed on or attached to the carriage 401. The lock latch 446 may be disposed on the carriage 401 such that it is fixed relative to longitudinal rotation of the space adjuster 400, or the lock feature 444 thereof. The lock feature 444 may be disposed on the space adjuster 400, or the cam shaft thereof, and may be a cavity, aperture, or cutout that is suitable to engage with the lock feature 446. In some implementations, the lock teatime 444 may engage with the lock latch 446 to lock the space adjuster 400, or the cam shaft thereof, in position, or, more specifically, in angular position. In other words, the lock latch 446 may lock the space adjuster 400 in a desired position, e.g., in the first stage, the second stage, or both, and may prevent inadvertent or accidental rotational movement of the spacing adjuster 400 out of such desired position. In some implementations, the lock feature 444 may have a detent structure to engage with the lock latch 446 in a detent manner.

Figure 5:
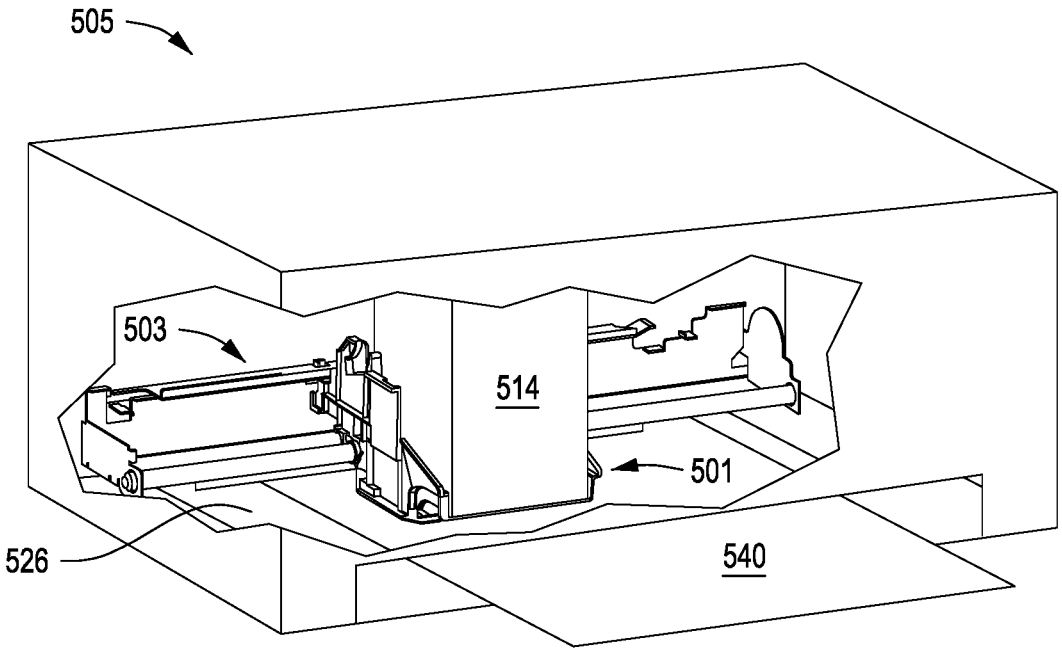
FIG. 5 is a perspective cutaway view of an example electronic device having an example space adjuster.

Referring now to FIG. 5, an example electronic device 505 having an example space adjuster (not shown) is illustrated. In some implementations, the electronic device 505 may include an example carriage assembly 503 having a carriage 501, on which the example space adjuster may be disposed. The example space adjuster and carriage assembly 503 may be similar to other example space adjusters and carriage assemblies described above. Further, the similarly-named elements of the example space adjuster and carriage assembly 503 may be similar in function and/or structure to the elements of other example space adjusters and carriage assemblies, as they are described above. The electronic device 505 may be an imaging device, in some implementations. Such imaging devices may include a printer, scanner, copier, plotter, three-dimensional (3D) printer or additive manufacturing device, or another type of imaging device. The carriage 501 may receive a cartridge 514, which may be a print cartridge and may contain, or may be a conduit for, print fluid, and may be similar to other, above-described cartridges. Print fluid may include ink or toner, in some implementations. In implementations wherein the electronic device 505 is a 3D printer, the cartridge 514 may include 3D printing material, such as a type of 3D printing powder or resin.

In some implementations, the electronic device 505 may perform operations on or with print media 540. Print media may include paper, card stock or cardboard, latex, vinyl, or another type of print media on which the electronic device 505 may perform print operations. In implementations wherein the electronic device 505 is a 3D printer, the print media 540 may be a bed or substrate onto which the cartridge may deposit 3D printing material. Additionally, the electronic device 505 may include a platen 526 over which the print media 540 may be delivered or driven. The platen 526 and a bottom surface of the carriage 501 may define an operation zone, sometimes referred to as a print zone, through which the print media 540 may be delivered. The space or distance between the platen 526, or the print media 540 thereon, and the bottom surface of the carriage 501 may be adjustable to optimize the quality of the operations performed by the electronic device, and/or to avoid damage to the print media 540. In some implementations, the space adjuster may be switchable between a first stage, defining a first space or distance above the platen 526, and a second stage, defining a second space or distance above the platen 526, which may be larger than the first space or distance. The operation of the space adjuster to switch between the first and second stages may be similar to the operation of space adjusters described above.

Figure 6A:
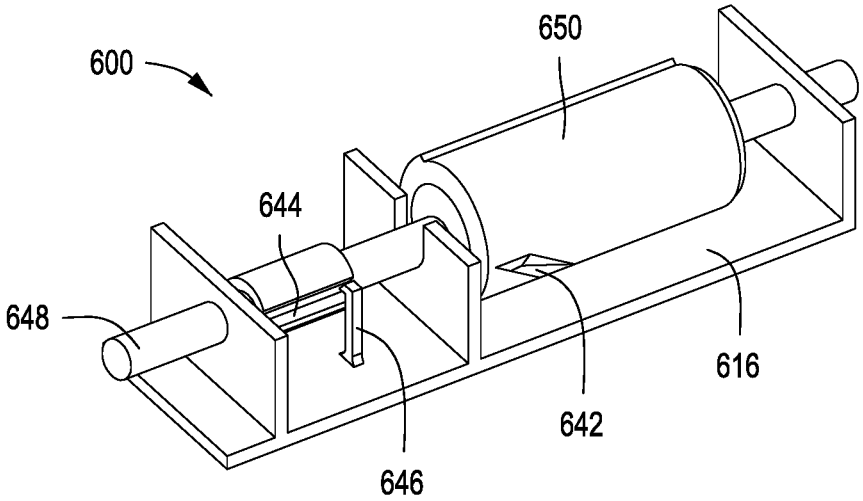
FIG. 6A is a perspective view of an example space adjuster.
Figure 6B:
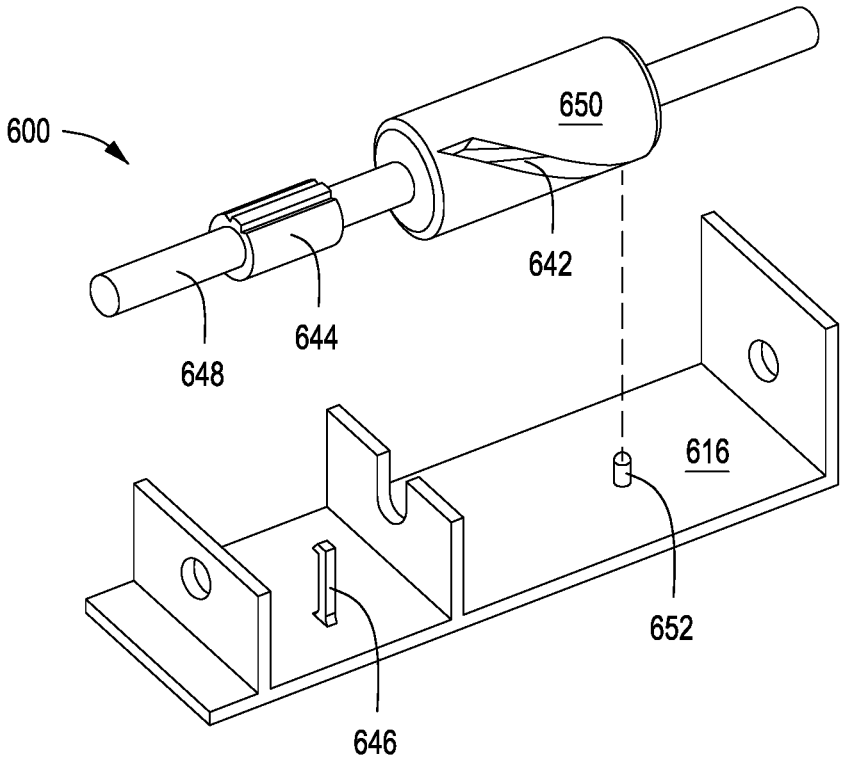
FIG. 6B is a perspective exploded view of an example space adjuster.
Figure 6C:
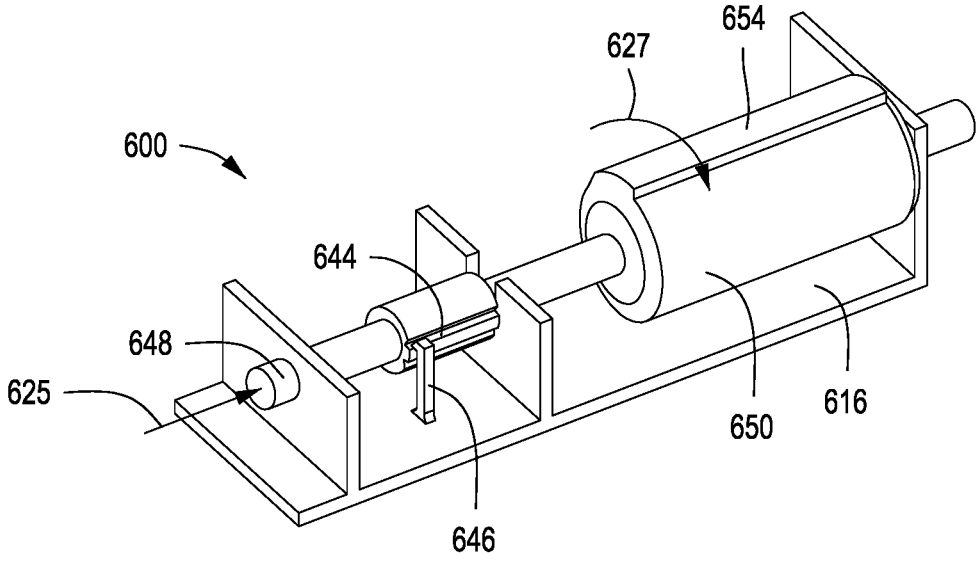
FIG. 6C is a perspective view of an example space adjuster.

Referring now to FIGS. 6A-6C perspective views of another example space adjuster 600 is illustrated. Example space adjuster 600 may include a support structure 616, a push rod 648, and a cam 650 disposed on the push rod 648. The cam 650 may include a drive slot 642, in some implementations, to engage with a drive pin 652 of the support structure 616. The push rod 648 may receive a push force 625, which may be similar or analogous to first and/or second longitudinal forces, as they are described above. Such a push force 625 may cause the cam 650, and thus the drive slot 642, to slide or move relative to the drive pin 652. The engagement of the drive pin 652 with the drive slot 642 may cause the cam 650 to rotate about a longitudinal axis of the push rod 648 in a direction similar to direction 627. Such a rotation 627 may cause a lobe 654 fixed on or attached to the cam 650 to engage with, or contact, press, or push against, a surface, e.g., a rail, of an electronic device within which the space adjuster 600 may be disposed. Similarly, a push force opposite to push force 625, which may be a pull force, in some implementations, may cause the cam 650, and thus the drive slot 642, to move relative to the drive pin 652 in a manner that is opposite to that just described. Therefore, in response to an opposite urging or force to push force 625, the drive pin 652 may cause the cam, and thus the lobe 654 to rotate in a direction opposite to direction 627, thereby disengaging the lobe 654 from the surface, e.g., the rail, with which it was engaged.

In further implementations, the space adjuster 600 may include a lock latch 646 and a lock feature 644 to engage with the lock latch 646. The engagement of the lock latch 646 with the lock feature 644 may lock the space adjuster in an angular position when the lobe 654 comes into contact with the surface so as to prevent the lobe 654 from accidentally coming disengaged with the surface. It should be noted that space adjuster 600 may be utilized in similar fashion to other space adjusters described above in order to adjust the space between a carriage and a platen, or media disposed thereon.

What is claimed is:

1. A space adjuster, comprising:

a carriage rod to support a carriage;

a rail to extend along a length of travel of the carriage;

a first actuator and a second actuator each spaced from the rail;

a cam shaft to be supported by the carriage;

a first fin disposed on a first end of the cam shaft, the first fin to contact the first actuator and having a first profile to transfer a first longitudinal force into a first rotation of the cam shaft;

a second fin disposed on a second end of the cam shaft, opposite from the first end, the second fin to contact the second actuator and having a second profile to transfer a second longitudinal force into a second rotation of the cam shaft, opposite to the first rotation; and a cam lug disposed on the cam shaft in between the first end and the second end, the cam lug to contact the rail and a cam surface of the cam lug to be spaced increasingly farther away from a longitudinal axis of the cam shaft throughout the first rotation of the cam shaft.

2. The space adjuster of claim 1, wherein the first longitudinal force is exerted against the first fin in a direction along the longitudinal axis of the cam shaft.

3. The space adjuster of claim 2, wherein the second longitudinal force is exerted against the second fin along the longitudinal axis of the cam shaft in a direction that is opposite to the direction of the first longitudinal force.

4. The space adjuster of claim 3, wherein the first fin is a set vane having a curvature that extends axially along the cam shaft, radially from the cam shaft, and circumferentially about the cam shaft to transfer the first longitudinal force into the first rotation of the cam shaft.

5. The space adjuster of claim 4, wherein the second fin is a reset vane having a curvature that is similar to the set vane and that extends axially along the cam shaft in a direction opposite from the set vane to transfer the second longitudinal force into the second rotation of the cam shaft.

6. The space adjuster of claim 1, further comprising a lock feature disposed on the cam shaft, the lock feature to engage with a lock latch to lock the cam shaft and the cam in angular position.

7. An imaging device, comprising:

a carriage to receive a print cartridge;

a frame, comprising:

a carriage rod slidably engaged with the carriage;

a rail extending along a length of a travel of the carriage;

a first actuator spaced from the rail and disposed at a first end of the frame; and a second actuator spaced from the rail and disposed at a second end of the frame, opposite the first end; and a space adjuster disposed on the carriage, comprising:

a cam shaft;

a first fin disposed on a first end of the cam shaft to receive and be actuated by the first actuator to cause a first rotation of the cam shaft;

a second fin disposed on a second end of the cam shaft, opposite the first end, and to receive and be actuated by the second actuator to cause a second rotation of the cam shaft, opposite to the first rotation; and a cam lug disposed on the cam shaft in between the first fin and the second fin, the cam lug to contact the rail to pivot the carriage away from the rail during the first rotation of the cam shaft.

8. The imaging device of claim 7, wherein a bottom surface of the carriage is to move away from a platen of an imaging device if the carriage pivots away from the rail during the first rotation of the cam shaft.

9. The imaging device of claim 7, wherein the cam lug is to rotate so as to pivot the carriage towards the rail during the second rotation of the cam shaft.

10. The imaging device of claim 9, wherein a bottom surface of the carriage is to move towards a platen of an imaging device if the carriage pivots towards the rail during the second rotation of the cam shaft.

11. The imaging device of claim 7, wherein the first actuator is to actuate the first fin if the carriage is moved to the first end of the frame, and the second actuator is to actuate the second fin if the carriage is moved to the second end of the frame.

12. An imaging device, comprising:

a carriage to receive a print cartridge, the print cartridge to deposit print fluid on print media;

a rail to extend along a length of travel of the carriage;

a first actuator and a second actuator each spaced from the rail;

a space adjuster disposed on the carriage, comprising:

a cam shaft;

a first fin disposed on a first end of the cam shaft, the first fin to contact the first actuator and having a first curvature to transfer a first longitudinal force into a first rotation of the cam shaft;

a second fin disposed on a second end of the cam shaft, opposite from the first end, the second fin to contact the second actuator and having a second curvature to transfer a second longitudinal force into a second rotation of the cam shaft, opposite from the first rotation; and a cam lug disposed on the cam shaft, the cam lug to contact the rail and a cam surface of the cam lug to be disposed increasingly farther from the cam shaft throughout the first rotation of the cam shaft and to press against a rail to pivot the carriage away from the rail during the first rotation and to pivot the carriage towards the rail during the second rotation.

13. The imaging device of claim 12, wherein a first actuator is to exert the first longitudinal force against the first fin to cause the first rotation if the carriage is moved to a first end of the imaging device.

14. The imaging device of claim 13, wherein a second actuator is to exert the second longitudinal force against the second fin to cause the second rotation if the carriage is moved to a second end of the imaging device.

15. The imaging device of claim 12, wherein the first rotation is to switch the space adjuster from a first stage to a second stage, and the second rotation is to switch the space adjuster from the second stage to the first stage.

* * * * *